US005594220A

United States Patent [19]

Hackbarth et al.

[11] Patent Number: 5,594,220

[45] Date of Patent: Jan. 14, 1997

[54] ROTARY SWITCH WITH CAM OPERATED SLIDING CONTACT ENGAGING NOBLE METAL STATIONARY CONTACT BAR SURFACE

[75] Inventors: David G. Hackbarth, New Berlin, Wis.; Kenyon A. Hapke, Libertyville, Ill.; Spencer C. Schantz, Dousman, Wis.

[73] Assignee: US Controls Corp., New Berlin, Wis.

[21] Appl. No.: 517,646

[22] Filed: Aug. 22, 1995

[51] Int. Cl.[6] ..... H01H 19/60; H01H 21/80; H01H 1/00

[52] U.S. Cl. ..... 200/6 B; 200/6 BB; 200/11 G; 200/241; 200/266; 200/569

[58] Field of Search ..... 200/6 B, 6 BA, 200/6 BB, 6 C, 11 G, 275, 283, 284, 241, 263–267, 268, 565, 568, 569

[56] References Cited

U.S. PATENT DOCUMENTS

| | | | |
|---|---|---|---|
| 2,525,408 | 10/1950 | Graybill et al. | 200/241 |
| 3,569,654 | 3/1971 | Murakami | 200/266 X |
| 3,725,624 | 4/1973 | Emmons | 200/6 B X |
| 3,731,032 | 5/1973 | Schantz | 200/6 BB |
| 3,971,904 | 7/1976 | Ward | 200/6 BB |
| 4,059,738 | 11/1977 | Mongeau | 200/6 B |
| 4,133,990 | 1/1979 | Wanner et al. | 200/6 B |
| 4,272,658 | 6/1981 | Crosby | 200/6 B |

*Primary Examiner*—J. R. Scott
*Attorney, Agent, or Firm*—Ryan, Maki, Mann & Hohenfeldt, S.C.

[57] ABSTRACT

In a rotary switch, a manually rotatable shaft turns a disk which has a plurality of riser cam segments on one of its faces. Stepwise rotation of the disk causes the cam segments to press down on flat spring contacts arranged in the switch to put the tip of one of the contacts at a time into contact with a stationary electrical contact bar that is coated with a noble metal. The spring contacts are configured such that when pressed by a cam the tips are caused to make contact with the stationary contact bar and then slide longitudinally so as the tip will pick up some of the noble metal coating from the contact bar. The tips are shaped with a traverse curve intersecting a longitudinal groove to thereby produce two points that make high unit stress contact with the stationary contact bar.

8 Claims, 4 Drawing Sheets

FIG. 5
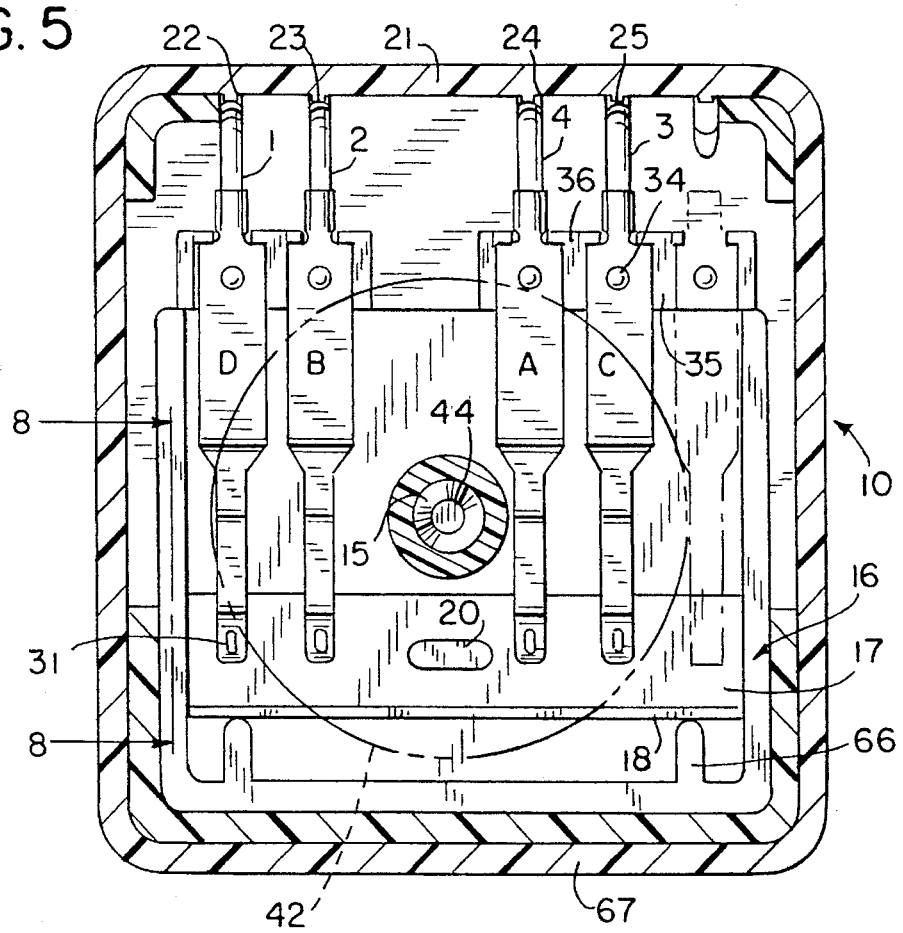
FIG. 8
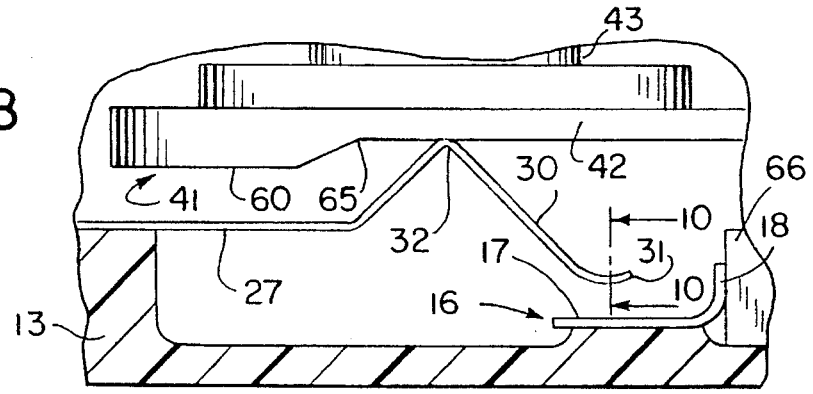
FIG. 9
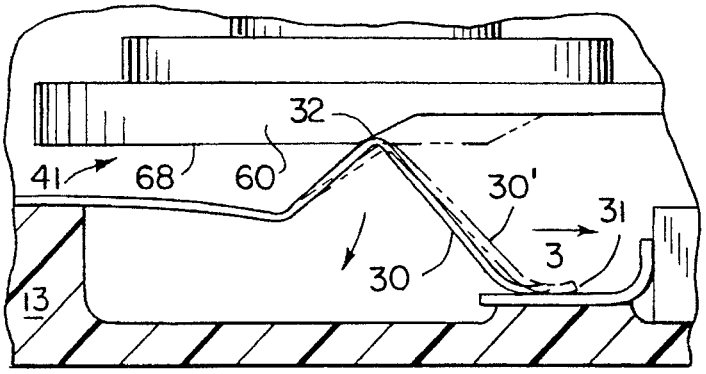
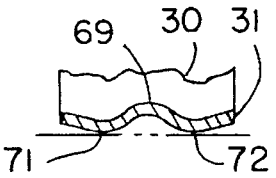
FIG. 10

ROTARY SWITCH WITH CAM OPERATED SLIDING CONTACT ENGAGING NOBLE METAL STATIONARY CONTACT BAR SURFACE

BACKGROUND OF THE INVENTION

The invention disclosed herein pertains to a multiple position rotary switch.

Rotary switches are used in many applications for switching current values of 1 mA to 25 amperes. Rotary switches of the indicated ratings are frequently used as control and function selectors in major domestic appliances such as dish and clothes washing machines and clothes dryers. The environment in these machines is usually wet, humid and soapy and is, therefore, hostile to electrical devices such as switches, connectors, and so forth. In the case of a rotary switch in such appliance, it is highly desirable for it to be sealed against entry of moisture or other contaminants which might cause a short circuit and/or corrosion that could disable the switch and the entire machine.

In most preexisting rotary switches, the stationary and movable contacts are coated with a non-oxidizing noble metal, silver being most common. Even so, a nonconductive or poorly conductive film may form on the contacts which can increase contact-to-contact resistance, unless the film is fractured when the stationary and movable contacts meet. Rotary switches having low current ratings usually utilize movable contacts that are rather small and have contact tips that are tiny. It is difficult to hold small contacts for applying a silver coating by electroplating, hot dipping or vapor deposition where it is desirable for cost reduction reasons to not coat the main body of the contact with costly noble metal.

SUMMARY OF THE INVENTION

The rotary switch described herein overcomes the above mentioned and other difficulties and problems experienced in preexisting rotary switches.

According to the invention, the new switch design comprises a base composed of nonconductive material such as synthetic resin. A common electric contact bar is mounted fixedly to the base interiorly of the switch housing. The contact bar has a noble metal coating, such as silver. A plurality of deflectable or bendable contacts composed of flat spring metal are mounted to the base in cantilever fashion such that the tips of the contacts are positioned above the stationary silver coated common electric contact bar. The flat spring metal contacts can be deflected by rotation of the switch shaft into contact with the fixed contact bar. The tips of the movable or flexible spring contacts are curved in two directions; namely, upwardly from the plane of the flat free end portion of the contact, firstly about an imaginary line that is transverse to the length or longitudinal direction of the spring contact and, secondly, downwardly about an imaginary line which extends longitudinally of the upwardly curved tip so as to create two laterally spaced apart high intensity contact points on the tip.

A rotor in the housing is comprised of a disk having an operating shaft that extends axially from the disk in one direction and a plurality of concentric curved riser cam segments extend in the opposite direction from the disk such that when the rotor is turned the cam segments press on the flexible spring contacts in a predetermined sequence. Pressing a spring contact causes its tip, when formed according to the invention as just described, to first touch the noble metal coated stationary contact bar after which, and in a continuous motion, the tip, with only its two contact points bearing on the noble metal slides on the contact points. Because all force applied by the cam to a spring metal contact is, in effect, distributed over only the two contact points at the tip, the unit stress is intense and a low resistance electrical contact between the tip of the flexible spring contact and a fixed noble metal coated contact bar is made. When the spring contacts are assembled in the switch housing no attempt has been made previously to apply a coating of noble metal to the tiny contact tips. The method used by applicant to apply a noble metal coating to the tips, according to the invention, is to operate the switch repeatedly after assembly. Because of the way the contact tips contact the stationary contact and then slide longitudinally on the coated stationary contact, the tips acquire some of the noble metal permanently. The high unit stress of the tips due to the double point configuration promotes transfer of noble metal to the spring contact tips.

How the foregoing problems and difficulties mentioned in reference to preexisting rotary switches are solved by the new rotary switch will appear in the more detailed description of the preferred embodiment of the invention which will now be set forth in reference to the drawings.

DESCRIPTION OF THE DRAWINGS

FIG. 5 is a vertical sectional view taken on a line corresponding to line 5—5 in FIG. 4;

FIG. 8 is a fragmentary sectional view taken on a line corresponding to line 8—8 in FIG. 5 showing one of the flexible switch contacts in detail and in unoperated position and showing the cam on the depicted rotor in readiness for deflecting the flexible switch contact for its tip to make contact with the stationary noble metal coated stationary contact bar;

FIG. 9 is similar to FIG. 8 except that the rotor is rotated sufficiently for one of its cams to deflect a movable switch contact into contact with a stationary contact bar; and FIG. 10 is a vertical sectional view taken on the line corresponding to the line 10—10 at the tip of the switch contact shown in FIG. 8 which reveals the upwardly turned aspect of the contact tip and where FIG. 10 reveals the transverse curve imparted to the contact tip for the tip to make two-point sliding contact with the stationary common contact bar.

DESCRIPTION OF A PREFERRED EMBODIMENT

Figures 1, 2:
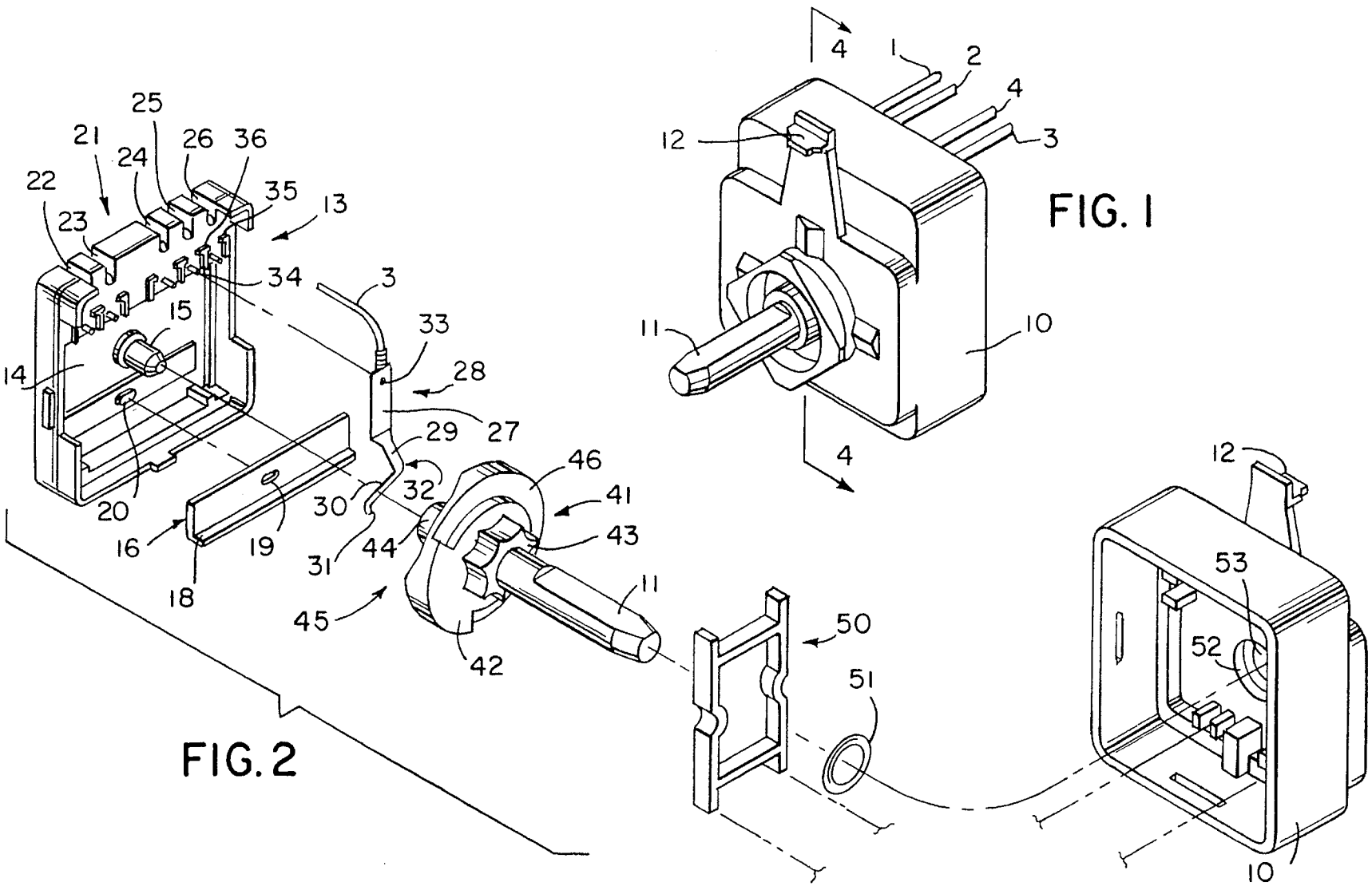
FIG. 1 is a perspective view of the new rotary switch as it appears when it is ready for installation.
FIG. 2 is a exploded perspective view showing the major parts of the rotary switch.

Attention is invited to FIG. 1 which shows the new switch fully assembled. The switch comprises a molded plastic housing 10 from which four lead wires marked 1,2,3 and 4 extend. The switch is operated by rotating a shaft 11. The depicted model of the switch described herein responds to rotation of shaft 11 by changing the digital logic signal levels of the individual leads from zeros to ones and vice versa. The switch has many uses such as in major home appliances, including clothes washers, dryers and dishwashers, for example. Major appliances using state-of-the-art technology usually have a microprocessor based controller, not shown, controlling the functions of the machine that are to be performed at the proper times. The new rotary switch provides digital signal values that the processor interprets and causes a programmed function to be performed.

FIG. 2 is provided for identifying the major parts of the rotary switch. The switch in FIG. 2 includes a base member 13 comprised of plastic insulating material. Base member 13 has a flat back wall 14. A stub shaft 15 projects integrally from the back wall 14. An elongated contact element or bar 16 is shown in position for being inserted and installed stationarily on the back wall 14 of base member 13. Stationary contact element 16 is basically a flat, rectangular bar having a stop edge 18 formed at a right angle. The contact element or bar 16 has a hole 19 which fits onto a plastic nib 20 projecting from the back wall 14 of base 13. After contact element 16 is fitted on the nib, the nib is heat swaged or flared to retain the contact element stationarily.

One edge 21 of base 13 in the illustrative embodiment of the switch in FIG. 2 has five notches 22–26. Not all of the notches are used in this model of the switch. In any model, a notch such as notch 26 is for accepting an insulated lead wire such as typical lead wire 3 which is also shown in FIG. 1. Typical lead wire 3 is electrically connected to a flat portion 27 of a thin spring metal contact 28. The typical deflectable spring contact 28 is preferably composed of phosphor-bronze. Spring contact 28 has two essentially flat portions 29 and 30 that are mutually angulated to create an offset which is herein called a knee 32. Contact 28 has a contact tip 31 which, according to the invention has two contact points rather than a traditional single point or an area contact when the tip 31 is forced into electrical contact with flat area 17 of stationary contact member 16 as will be elucidated later.

In accordance with one feature of the invention, at least the flat area 17 of contact bar 16 is coated with an oxidation resistant noble metal film such as gold or silver. Silver is preferable for cost reducing reasons and because it has lubricating properties too. The tip 31 of spring contact 28 is originally, that is, before the rotary switch is cycled several times, just bare phosphor-bronze without any silver coating. Having the tip coated with silver, for example, would be desirable. It is, however, difficult, expensive and time consuming to coat the tip by electroplating, sputtering or vapor deposition of metal as is commonly done. According to the invention, however, the contact tip 31 obtains a coating of non-oxidizing and lubricating metal by mechanical means after the switch is assembled resulting from having the spring contact tip 31 forced into contact with stationary contact element 16 by a cam, shown later, on the disk 42 of a shaft driven rotor which is generally designated by the numeral 41 in FIG. 2.

After contact is made between the spring contact tip 31 and flat stationary contact element 16, the cam presses against knee 32 of typical spring contact 28 which causes the initially uncoated tip 31 of the typical contact 28 to contact and slide longitudinally on contact bar 16 to acquire some of the noble metal coating of the contact element as will be elaborated later.

Observe in FIG. 2 that typical spring contact 28 has a hole 33. There is a row of molded pins, such as the pin marked 34, also shown in FIG. 4, projecting from base member 13. The hole 33 in contact 28 slides over typical pin 34. By placing the hole 33 on pin 34, the flat portion 27 of contact 28 becomes captured between ribs 35 and 36 which project from base member 13. When the spring contact 28 is in place, for example, its lead wire 3 is pressed into a notch 26 on the upper rim of base 13. Ultimately, when base member 13 is fitted into housing 10, the back of the base is sealed around its edges with a resin, such as an epoxy resin, so the lead wire 3 becomes bonded in notch 26 and the epoxy seals around the joint between the perimeter 13 of the base and the interior perimeter of the housing as will be explained in more detail later.

In FIG. 2, rotor 41 is unitary with shaft 11, with a rotor disk 42 and with a toothed index wheel 43. A shaft end portion 44 has an axial bore, not visible in FIG. 2, which constitutes a journal bearing fitting on a fixed stub shaft 15 which projects integrally from base 13. The side of rotor 41 to which the arrowheaded line 45 points has a plurality of concentric spring contact operating riser cams which will be exhibited in other views and will be discussed later.

Rotor 41 has on a side facing the viewer in FIG. 2 a stop segment 46. The angle subtended by segment 46 determines the angle through which the shaft 11 and, hence, rotor 41 can rotate in either direction between stops which are not visible in FIG. 2. This angle can differ among different versions of the rotary switch used in different applications.

A double-legged spring 50 composed of plastic is shown in FIG. 2. It is sufficient to mention at this time that the spring 50 contacts with index wheel 41 in the assembled rotary switch.

Figure 4:
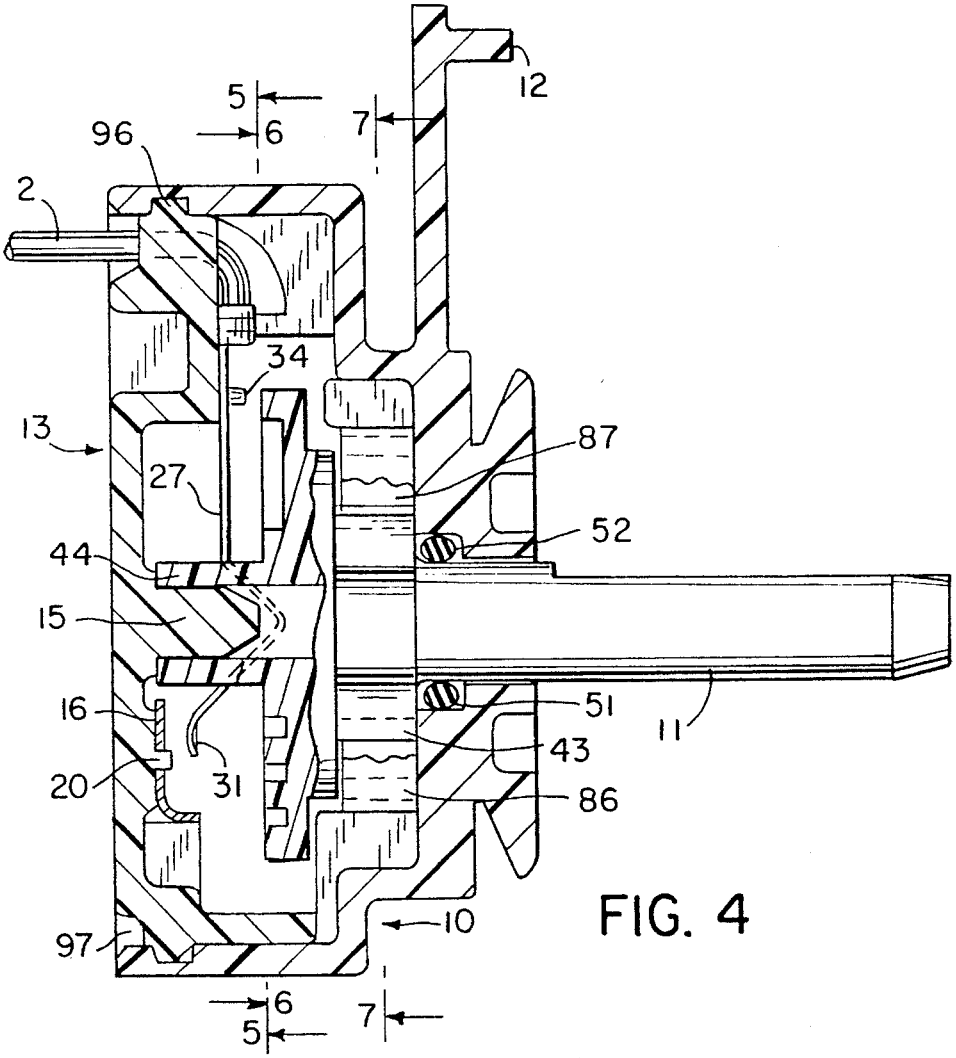
FIG. 4 is a sectional view taken on a line corresponding to line 4—4 in FIG. 1.

As shown in FIGS. 2 and 4, an O-ring 51 is sized to fit on shaft 11 next to index wheel 43 to effect a seal between shaft 11 and an annular channel 52 surrounding a hole 53 for the shaft 11 in housing 10. The inside diameter of the O-ring is less than the outside diameter of the shaft so the O-ring is stretched to effect a tight seal between the ring and shaft. The outside diameter, being greater than the inside diameter of channel 52, results in the O-ring experiencing a compressive force when the O-ring is urged into channel 52 so a tight seal is formed between the outside diameter of the O-ring and channel wall.

Figure 3:
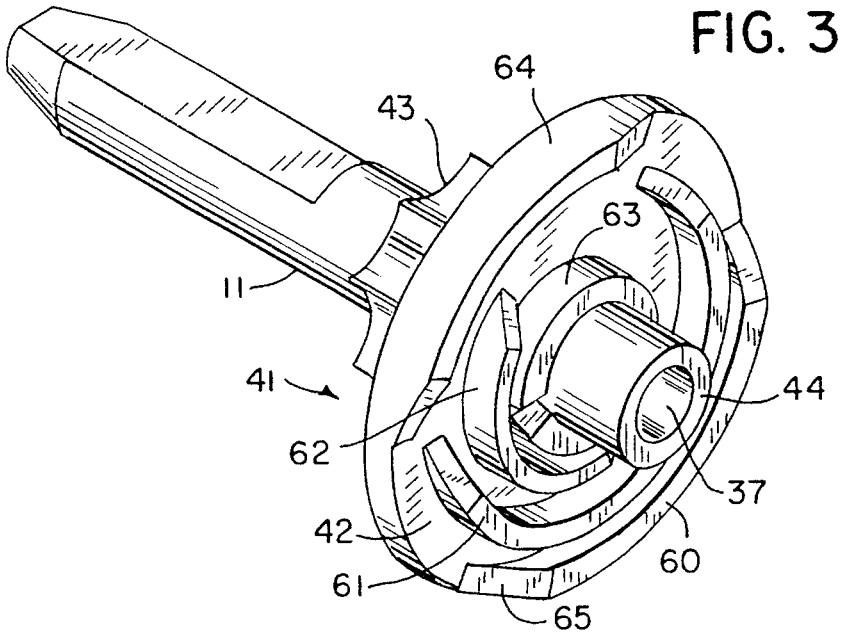
FIG. 3 is a perspective view of one model of several alternative models of a unitary rotor used in the new switch.

An illustrative rotor 41 version is shown in FIG. 3. All of the so-called versions of the rotor have in common shaft 11, end shaft journal 44 with the journal bore 37 for fitting rotatably on base stub shaft 15, a rotor disk 42 and an index wheel 43. A feature present in all models or versions of the new rotary switch, according to the invention, is the use of cam operated spring contacts which, as alluded to earlier, have their tips slide longitudinally for the point contacts thereon to acquire a noble metal coating from the coated stationary contact bar 16. Various versions of the rotor used in different applications of the switch differ in respect to the number of angular positions the rotor is allowed to take and in respect to the rotational angle of the rotor.

The illustrative rotor 41 in FIG. 3 has formed on its distal side, or the side axially remote of disk 42 from shaft 11, a plurality of concentric cam segments 60, 61, 62, 63 and 64. Both ends of each cam segment are tapered as typified by the tapered end marked 65 on cam 60. The tapered ends provide for the cams to ride onto the knees 32 of the spring contacts smoothly to urge the spring contact tips 31 into closing contact with the stationary common noble metal coated contact bar 16.

Attention is now invited to FIGS. 5–10. FIG. 5 shows four spring contacts marked A, B, C and D installed on base member 13 on typical pins 34. Contact C is typical. A part of the flat area 27 of typical spring contact C is stabilized against misalignment and turning on swaged plastic pin 34 by the end portion of the flat area being captured between the previously mentioned T-shaped ribs 35 and 36. The current interchange tip 31 of deflectable spring contact C overhangs in cantilever fashion the silver or other noble metal coated stationary contact bar 16. The rotor disk 42 is exhibited with a phantom circle in FIG. 5. Stationary contact bar 16 is electrically considered a common line terminal. It is blocked against shifting by reason of its upstanding margin 18 abutting a pair of stops 66 which project inwardly of a rim 67 of base 13. The swaged plastic anchor pin 20 holds the stationary contact 16 in a fixed position.

The profile of a typical contact C is shown supported in cantilever fashion in FIG. 8. Cam 60 on disk 42 of rotor 41 has not been rotated onto knee 32 of movable spring contact C as yet in FIG. 8. Hence, the uniquely formed tip 31 of the spring contact is not making electrical contact with the flat portion of stationary noble metal coated contact 16 as yet. In FIG. 9, rotor 41 has rotated or has been indexed sufficiently for the tapered leading end 65 of cam 60 to apply a force on knee 32 which causes contact C, particularly, its tip 31 to make physical and electrical contact with noble metal coated stationary contact 16. As the tapered end 65 of cam 60 advances along knee 32, tip 31 of the spring contact deflects as indicated by part 30 of the contact assuming the phantom line position 30' in FIG. 9. The deflection results in tip 31 of the spring contact sliding on stationary contact bar 16. The sliding is an important feature of the invention since the tip 31 thereby picks up some of the noble metal, usually silver, from the stationary contact 16 after the rotary switch is assembled. Thus, the problem of getting a silver coating on the tiny tip by conventional sputtering, electroplating or metal vapor deposition is avoided to great advantage. The noble metal deposit acquired by the sliding spring contact tip 31 improves the lubricity between contact tip 31 and the coated stationary contact bar 16 and results in extending the life of the switch contacts. After the switch is assembled the shaft 11 is turned several times to effect the silver transfer process and condition the switch for customer usage.

The configuration of tip 31 of the spring contact is another important feature of the new rotary switch. Observe in FIGS. 8 and 9 that tip 31 had a downwardly convex and upwardly bent profile. The upward bend is on a line that is transverse to the length of the contact spring or perpendicular to the drawing sheet in FIG. 8 where the section line 10—10 cuts through the tip. A section through this convex profile is exhibited in FIG. 10 where one may see that the parts of the tip are symmetrical to the central region 69 and are convex downwardly. The favorable result of this configuration is that the spring contact tip 31 makes two-point contact at points 71 and 72 with the noble metal coated top surface 17 of stationary contact 16. Since all of the force applied to the offset or knee 32 by cam 60, is transmitted to the tip 31 of the spring contact and because the spring contact tip makes only two points of contact 71 and 72 with the stationary contact bar, the unit stress on points 71 and 72 is high and, therefore, the points when wiping along the noble metal coated surface perform a good cleaning and self-plating action.

Spring contacts A, B and D in FIG. 5 are identical structurally to spring contact C which was just discussed. The tips 31 of all of these contacts perform a wiping action when they are pressed by the cams onto stationary contact 16. Contact A is a common contact. Its lead 4 is an input lead that is fed from a voltage source, not shown. The tip of power infeed common contact A makes contact with stationary contact 16 as soon as rotor 41 is turned through its first angular step from fully off position or 000 bit position, that is, from an angular position where all spring contacts are not touching stationary contacts 16 and the contact between spring contact A and stationary contact bar 16 is maintained until the switch is operated back to off position wherein none of the spring contact tips 31 are in electrical contact with stationary contact 16.

Figure 6:
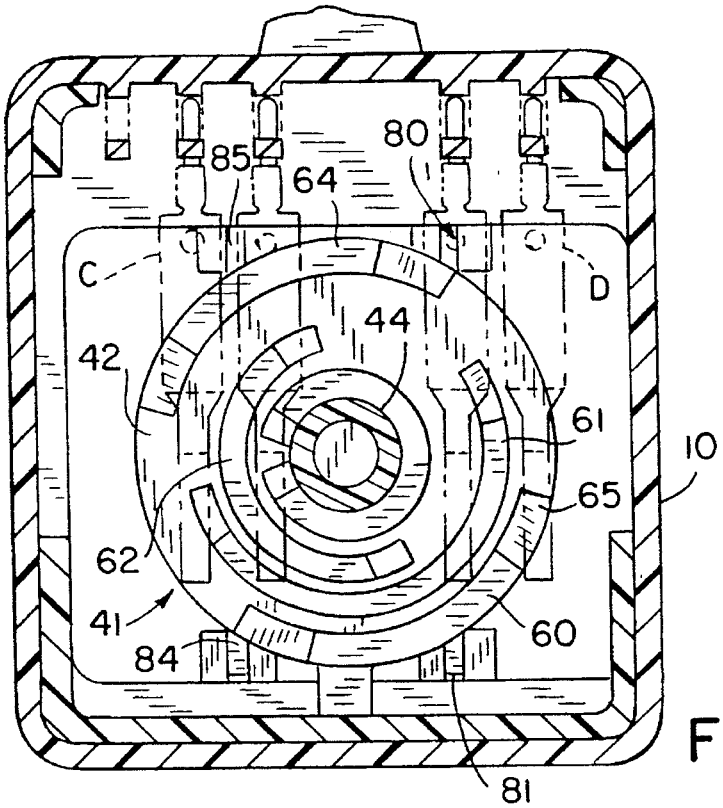
FIG. 6 is a vertical sectional view taken along a line corresponding to line 6—6 in FIG. 4.

If the housing 10 with the cams of the rotor 41 facing toward the observer in FIG. 6 is flipped over and superimposed on the base 13 in FIG. 5, the cams on the rotor become properly related to their cooperating contacts A, B, C and D which the respective cams operate. Thus, voltage infeed contact A in FIG. 5 is in the circular rotational path of radially innermost cam 63 in FIG. 6. The spring contacts A–D are shown in phantom lines in FIG. 6 since they are actually mounted in base 13 rather than housing 10. The first angular step of the rotor from off position results in connecting infeed common spring contact A to stationary contact 16 so that contact 16 is electrified at a voltage corresponding to customary digital logic voltage of about five volts, for example. As is evident in FIG. 6, the spring contacts A, B, C and D are arranged in phantom mirror image to what they are in FIG. 5. As soon as the leading end of cam 63 is turned through an angle of 45 degrees in the direction of arrow 73, spring contact A makes contact with stationary contact 16. In this particular version of the switch, cam 63 intercepts a central angle of a total of 270° and would return to the angular position in which it is shown in FIGS. 6 and 3 after the rotor 41 has been rotated to 270°.

The next radially outwardly displaced cam 62 in FIG. 6 and 13 acts on spring contact B when the rotor and, hence, cam 62 is rotated three angular increments of 45° each. Cam 62 subtends an angle of 135°.

The next radially outwardly displaced cam 61 in FIG. 6 begins to act on spring contact C when the rotor and cam 61 rotate 45° from switch off position or 000. Cam 61 subtends and angle of 135°.

Radially outermost cams 60 and 64 operate spring contact B. When rotor 41 has turned two angular increments from switch off position, cam 64 operates spring contact D. After the next 45° increment of rotation, rotor 41 rotation, spring contact D opens because cam 64 subtends an angle of 45° which is one angular step. After the rotor rotates 270°, the cam 60 operates the spring contact to a conductive state again.

Figure 7:
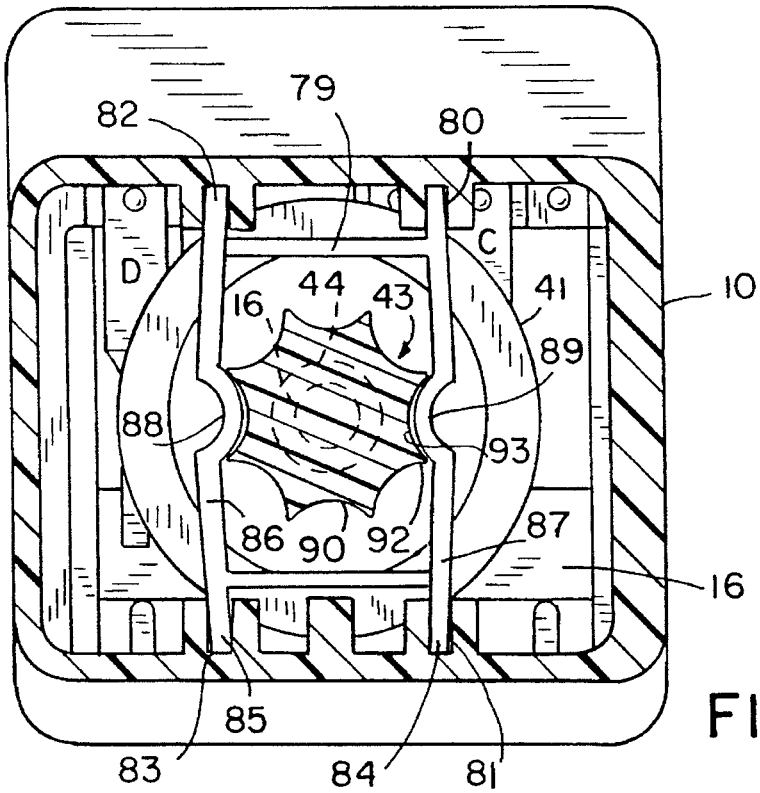
FIG. 7 is a sectional view taken on a line corresponding to line 7—7 in FIG. 4.

Spring 50 is shown installed in switch housing 10 in FIG. 7. The housing has four interior slots 80, 81, 82 and 83 into which typical leg tips 84 and 85 register. Typical legs 86 and 87 have centrally positioned curved convex detents 88 and 89, respectively. Legs 86 and 87 are tied together by struts 79. In FIG. 7 it is evident that, in a sense, the index wheel 43 is sufficiently large diametrically, compared to the distance between detents 88 and 89 so that legs 86 and 87 of the spring 50 become deflected when the spring is pressed onto the index wheel 43. In other words, the spring 50 is slightly prestressed when the rotor shaft and, hence, the index wheel 43 are not rotating.

Although a preferred embodiment of the invention has been described in detail, such description is intended to be illustrative, rather than limiting, for the invention may be variously embodied and is to be limited only by interpretation of the claims which follow.

What is claimed is:

1. A switch comprising:

a base composed of insulating material, an elongated contact bar fixedly mounted to said base and having an exposed surface coated with a noble metal, a housing joinable with said base, a row of movable spring contacts each comprised of a spring metal strip having one end portion mounted to said base and having an opposite deflectable free end portion extending in cantilever fashion away from said one end portion, said free end portion having an offset and having a part continuing beyond said offset and terminating in a contact tip which is spaced from said exposed surface of said stationary contact when the offset in said free end portion is not deflected, a shaft journaled in said housing, said shaft having a coaxial disk on which there are a plurality of concentric cam segments of such circumferential length, axial height relative to said disk and arrangement as to engage said offsets in succession in response to rotation of said shaft to thereby deflect said spring contacts, respectively, causing said contact tips thereof to contact said noble metal coated surface and subsequently slide laterally on said stationary bar surface to acquire a coating of said noble metal.

2. A rotary switch comprising:

a base member and a housing joinable with the base member, an elongated contact bar mounted stationarily to and extending laterally of said base member, said contact bar having an exposed surface coated with a noble metal, a row of movable spring contacts each comprised of a metal strip having one end portion fastened to said base member and having an opposite deflectable free end portion extending in cantilever fashion away from said one end portion, said free end portion having an offset and having a part continuing beyond said offset and terminating in a contact tip which is spaced from said exposed surface of said stationary contact bar when said free end portion is not deflected, a rotor including a disk having opposite sides, an operating shaft extending from one side of the disk through said housing and the side opposite of the disk from said one side having a surface from which a plurality of concentric cam segments having a predetermined axial height project, said axial height of said cam segments relative to said surface being sufficient for said cam segments to press on said offsets of said spring contacts, respectively, in succession in response to rotation of said disk, with sufficient force for deflecting said free end portion to cause said contact tips to contact said exposed surface of said contact bar and subsequently slide longitudinally across said bar for said tips, respectively, to acquire a coat of noble metal from said exposed surface.

3. A switch according to any one of claims 1 or 2 wherein said tips of the spring contacts have a convex curvature about a line extending transversely of said tips for said tips to be convex in a direction toward said stationary contact bar and said tips have a curvature about a line extending longitudinally of the spring contacts across said convex curvature so as to define two contact points, one on each side of the longitudinally extending line which points contact said stationary contact bar.

4. A switch according to any one of claims 1 or 2 wherein:

insulated lead wires are connected to said spring contacts, respectively, said base has a margin in which there is a row of adjacent notches through which said lead wires, respectively, pass, said housing has side walls configured for the housing to fit snugly on said base with one of said walls overlaying said notches and the lead wires therein, and said notches are filled with a sealant embedding said lead wires for preventing moisture from entering said housing and for providing stress relief to the lead wires.

5. A switch according to claim 4 wherein when said housing is fitted on said base, said side walls of said housing define a moat about the perimeter of the base, and said moat is filled with a sealant.

6. A switch according to any one of claims 1 or 2 including:

an elongated planar surface on said base, pairs of laterally spaced apart ribs projecting integrally from said surface, a pin projecting integrally from said surface between the ribs in each pair, and said end portions of said metal spring contacts each having a hole, for fitting onto a said pin between ribs in a pair.

7. A switch according to any one of claims 1 or 2 wherein said noble metal coat on said contact bar is silver.

8. A method of coating the tips of a plurality of movable contacts with a noble metal such as silver, comprising the steps of:

forming movable contacts of a strip of spring metal with each contact having an offset knee located between the ends of each contact and with each contact extending to and terminating in a small contact tip on one side of the knee, the tip being devoid of a noble metal coating, mounting on an insulating material base a contact element having a surface on which there is a layer of noble metal, mounting said movable contacts to said base in cantilever fashion with the tips of the movable contacts overhanging said surface of the contact element, providing an operating device in a housing for said switch that is operable to press on said offset knees repeatedly and cause said contact tips to deflect to make contact with and then slide along the noble metal layer on said contact element for said tips to acquire a coating of noble metal, and assembling the housing to said base and then operating said operating device to cause said contact tips to acquire said noble metal.

* * * * *